US006619756B1

(12) United States Patent
Holl et al.

(10) Patent No.: US 6,619,756 B1
(45) Date of Patent: Sep. 16, 2003

(54) CHISEL HOLDER CHANGING SYSTEM

(75) Inventors: Bernd Holl, Neustadt/Wied (DE); Dieter Simons, Buchholz (DE); Günter Hähn, Königswinter (DE)

(73) Assignee: Wirtgen GmbH Maschinenbau, Windhagen (DE)

( * ) Notice: Subject to any disclaimer, the term of this patent is extended or adjusted under 35 U.S.C. 154(b) by 0 days.

(21) Appl. No.: 09/914,419

(22) PCT Filed: Jan. 22, 2000

(86) PCT No.: PCT/EP00/00477

§ 371 (c)(1),
(2), (4) Date: Aug. 27, 2001

(87) PCT Pub. No.: WO00/52303

PCT Pub. Date: Sep. 8, 2000

(30) Foreign Application Priority Data

Feb. 27, 1999 (DE) ..... 199 08 656

(51) Int. Cl.[7] ..... E21C 35/19; E21C 35/193
(52) U.S. Cl. ..... 299/85.2; 403/84; 299/102
(58) Field of Search ..... 299/39.8, 85.2, 299/102, 103, 104, 105, 106, 107, 108, 109, 110, 111; 403/83, 84, 87, 88, 94, 96; 411/537, 539; 16/430, 900

(56) References Cited

U.S. PATENT DOCUMENTS 2,972,802 A * 2/1961 Stein ..... 407/39
3,749,449 A * 7/1973 Krekeler ..... 299/102
4,609,227 A 9/1986 Wild et al.
4,762,372 A 8/1988 Rassmann et al.
5,007,685 A * 4/1991 Beach et al. ..... 299/85.2
5,078,540 A * 1/1992 Jakob et al. ..... 404/90
5,623,742 A * 4/1997 Journee et al. ..... 403/83
5,836,561 A * 11/1998 Liao ..... 403/87
6,106,181 A * 8/2000 Neuhof ..... 403/84

FOREIGN PATENT DOCUMENTS

DE 43 22 401 6/1996
GB 1 573 505 8/1980

* cited by examiner

*Primary Examiner*—David Bagnell
*Assistant Examiner*—Brian Halford
(74) *Attorney, Agent, or Firm*—Pauley Petersen Kinne & Erickson

(57) ABSTRACT

A chisel-holder changing system for a road milling machine, a coal cutting machine or the like to which a chisel-holder is fastened in an exchangeable manner by means of a connecting mechanism. The chisel-holder accommodates at least one chisel that can be exchanged. The middle longitudinal axis of the chisel is set at an operating angle of less than 90° with respect to the surface to be worked. In order to be able to obtain varied removal results using such a chisel-holder changing system, the chisel-holder can be fixed in two or more configuring positions to the base part and in different attachment positions of the chisel, the middle longitudinal axis of the chisel is slanted at various working angles.

18 Claims, 5 Drawing Sheets

CHISEL HOLDER CHANGING SYSTEM

BACKGROUND OF THE INVENTION

1. Field of the Invention

This invention relates to a chisel-holder changing system for a road milling machine, a coal cutting machine, or the like, to which a chisel holder is fastened in an exchangeable manner by a connecting mechanism, wherein the chisel holder accommodates at least one chisel that can be exchanged, and wherein a central longitudinal axis of the chisel is set at a working angle of less than 90° relative to the surface to be worked.

2. Description of Related Art

A chisel-holder changing system is known from German Patent Reference DE 43 22 401 C2. The chisel-holder changing system features a base part that is welded onto a surface of a roller body that projects outwardly. The base part has a plug receiver, in which a plug connector of the chisel holder can be inserted. The chisel holder has a receiving hole, in which the chisel shaft of a circular-shaft chisel is inserted. The chisel holder can be fixed to the base part using a fastening screw. In the assembled state, the central longitudinal axis, the axis of rotation, of the circular-shaft chisel is slanted with respect to the surface to be worked.

SUMMARY OF THE INVENTION

One object of this invention is to provide a chisel-holder changing system of the initially mentioned type, with which different removal results can be obtained with regard to the quality of the worked surface.

This object is achieved with a chisel holder that can be fixed in two or more attachment positions to a base part, and a central longitudinal axis of the chisel is slanted at different working angles in the various attachment positions.

Due to different settings of the chisel, a single chisel-holder changing system can realize different removal results. For example, for road milling, through variation of the working angle, either coarse or fine milling can be produced.

According to one preferred embodiment of this invention, the chisel holder is supported by a support surface on a contact surface of the base part, and for implementing the different attachment positions, the chisel holder can be moved on its support surface relative to the contact surface.

In order to be able to change the chisel position quickly, it is possible to adjust the chisel holder stepwise relative to the base part. In particular, the individual steps correspond to determined, preferred working angles. For road milling, these angles are, for example, 35°, 40°, and 45°.

The step-wise adjustment can be implemented, for example, such that the chisel holder has toothing that engages counter-toothing of the base part, and such that the toothing and the counter-toothing have flat support edges that extend perpendicular to the movement direction of the chisel holder relative to the base part. With the support edges, the forces occurring during operation can be reliably transferred into the base part.

Normally, the chisel-holder changing system is mounted on a roller-shaped base that can move about an axis of rotation. So that the forces acting in the direction of the axis of rotation can also be reliably received in the working insert, a chisel-holder changing system according to this invention has the counter-toothing of the base part with two sets of partial toothing. The sets of partial toothing are slanted for receiving transverse forces in the direction perpendicular to the direction of advance of the chisel.

An alternative embodiment of the chisel-holder changing system can be implemented, for example, so that the base part has a contact part that is configured with a plurality of concentrically arranged tooth elements of the counter-toothing. The chisel holder carries a gripping plate that has toothing adapted to the counter-toothing, and the chisel holder can rotate relative to the base part about an adjustment axis that is perpendicular to the direction of advance of the chisel. Such a connecting mechanism can also be configured as Hirth-type serrations. Due to the plurality of tooth elements, extremely high forces can be transmitted by this connecting mechanism.

In order to create a fixed connection of the chisel holder to the base part, which simultaneously allows simple and quick changing of the working angle, in one embodiment of this invention the chisel holder has a base carrying a holder attachment for receiving the chisel. The base features an oblong hole that is aligned with a threading receiver of the base part. A fastening screw can be inserted into the oblong hole and the screw can be screwed into the threading receiver, and the chisel holder can be adjusted when the fastening screw is removed.

A screw head of the fastening screw can be housed for protection in a recess that expands and connects to the oblong hole.

An especially good and quick attachment of the screw head to the chisel holder can be achieved if the screw head is designed as an oval-head screw head.

Wear or excessive stress can damage a chisel holder. In order to prevent the chisel holder from breaking uncontrollably and damaging the base part, the chisel holder carries a holder attachment on a base. The holder attachment has a receiving hole for the chisel stem, and the holder attachment is connected to the base through a set breaking point.

BRIEF DESCRIPTION OF THE DRAWINGS

This invention is explained in greater detail with reference to embodiments shown in the drawings, wherein.

DESCRIPTION OF PREFERRED EMBODIMENTS

Figure 1A:
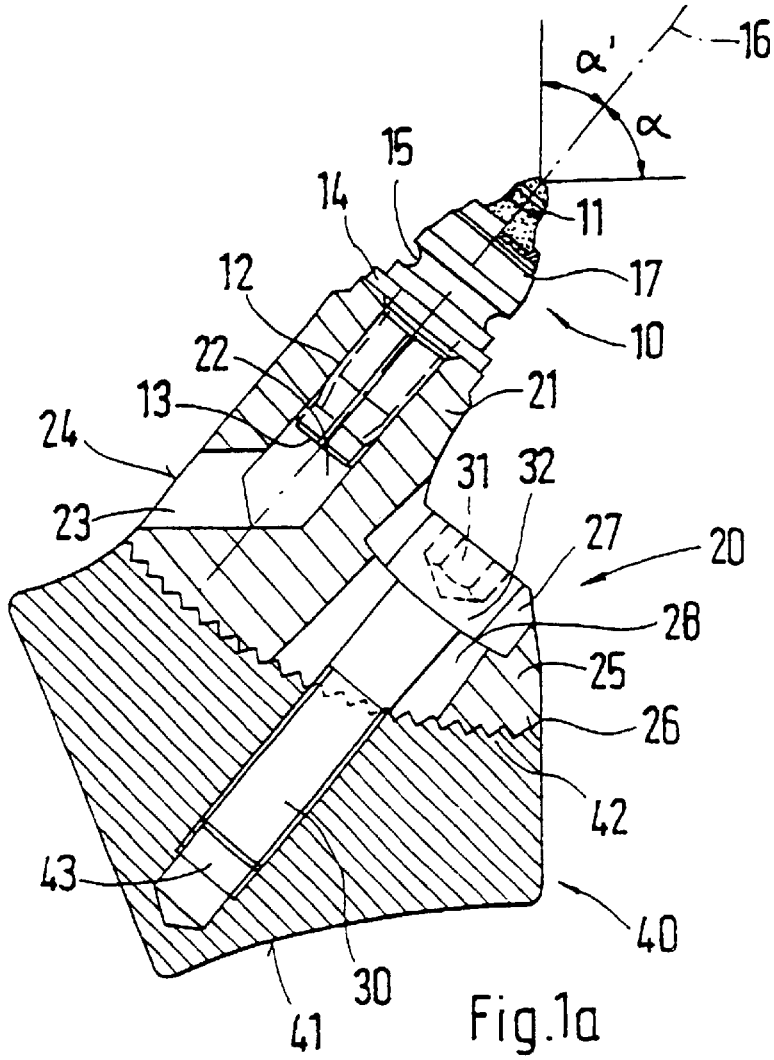
FIGS. 1A and 1B show a chisel-holder changing system in two different views and in a first setting position.

FIG. 1 shows a chisel-holder changing system that has a base part 40 and a chisel holder 20. The base part 40 has a lower connection surface 41, with which the base part 40 can be set on a roller-shaped base, for example, a road milling machine. The connection to the roller-shaped base is by welded joints. On its side facing upwards, the base part 40 has a curved contact surface. The contact surface has counter-toothing 42. The individual teeth of the counter-toothing 42 are designed with a triangular cross section, as shown in FIG. 1A, and thus form two contact edges. The teeth of the counter-toothing 42 extend over the entire width of the base part 40. A threaded receiver 43 is worked into the contact surface of the base part 40 at the center of the width of the teeth. In this way, the threaded receiver is arranged so that it occupies the greatest space possible in the base part 40 and therefore provides a sufficient thread length for a fastening screw. As shown in FIG. 1A, the threaded receiver 43 is formed slanted in the contact surface. Due to this space-saving arrangement, a small total height of the base part 40 can also be realized. This has special advantages because the entire construction of the chisel-holder changing system can thus be kept small.

The chisel holder 20 can be installed on the base part 40. The chisel holder 20 has a base 25 that has an oblong hole 28. The oblong hole 28 extends to the outer side of the base 25 by a recess 27. The fastening screw, which represents the connection mechanism 30, can be inserted through the oblong hole 28 and screwed into the threaded receiver 43. In this way, the screw head 32 is then housed protected in the recess 27. Tightening a fastening screw presses the screw head 32 against the chisel holder 20 in the transition region between the oblong hole 28 and the recess 27. Here, toothing 26 of the base 25 can be maintained in tight engagement with the counter-toothing 42. Due to the plurality of teeth in engagement, a large connecting surface is formed, wherein the chisel holder 20 can be pressed against the base part 40 and large forces can be transferred during operation through this connecting surface.

The base 25 features a projecting holder attachment 21, in which a receiving hole 22 is formed. The central longitudinal axis of the receiving hole 22 is thus perpendicular to the curved contact surface of the base part 40. A discharge channel 23 is bored in the chisel holder 20 from the back side of the chisel-holder changing system. The discharge channel 23 crosses the receiving hole 22. A chisel 10 can be inserted in the receiving hole 22. The chisel 10 features a chisel head 17 that carries a chisel joint 11. The chisel joint 11 is designed as a hard metal element. A chisel stem is connected to the chisel head 17 and an adapter sleeve 12 is pulled onto the shaft. The adapter sleeve 12 is braced in the receiving hole 22. Simultaneously, the adapter sleeve 12 retains the chisel stem of the chisel 10 and thus prevents it from falling out. In the inserted state, the chisel head 17 lies on a wear protection disk 14. The wear protection disk 14 is supported on the chisel holder 20 around the receiving hole 22. The chisel 10 can be pulled from the receiving hole 22 by two different methods. In one method, a discharge pin can be inserted through an inlet opening 24 into the discharge channel 23 until the pin contacts a front surface 13 of the chisel stem. Then, with the blow of a hammer, the chisel stem can be removed from the receiving hole 22. In the other method, a circumferential removal groove 15 is formed in the chisel head 17, and a removal tool is inserted into the groove 15. By means of a lever, the chisel 10 can then be removed from the receiving hole 22.

Figure 1B:
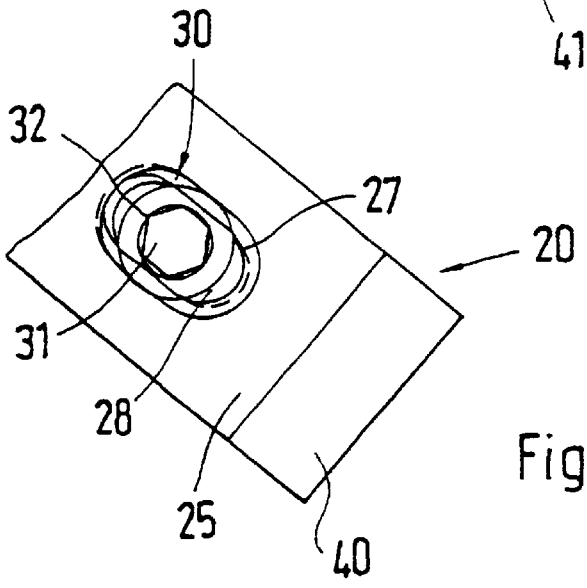
Figure 2A:
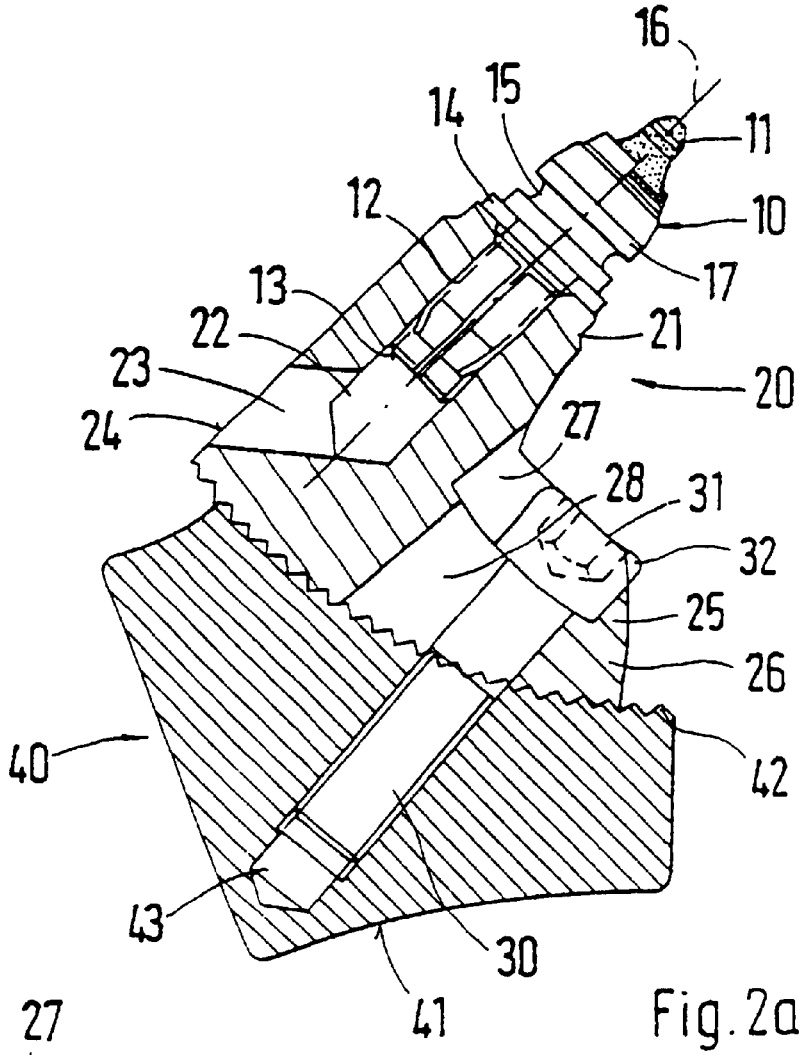
FIGS. 2A and 2B show the chisel-holder changing system from FIGS. 1A and 1B but in a second setting position.
Figure 2B:
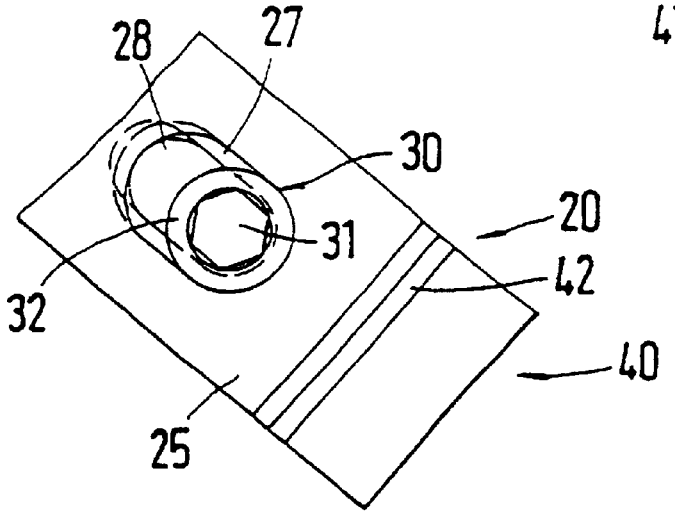

As shown in FIGS. 1A and 1B, the fastening screw is arranged in the middle in oblong hole 28. This results in a working angle $\alpha$ that is used to adjust the central longitudinal axis 16 of the chisel 10 with regard to the surface to be worked. The complementary angle is shown in FIG. 1A with $\alpha'$. When this working angle $\alpha$ is to be changed, merely the fastening screw must be loosened. The chisel holder 20 can then be moved relative to the base part 40. Subsequently, the fastening screw is tightened again so that the toothing 26 can be braced against the counter-toothing 42. Such a changed setting position is shown in FIGS. 2A and 2B. At this position, the working angle $\alpha$ is 45° (compared with the previous setting of 40°). In the setting position according to FIGS. 2A and 2B, the fastening screw and the screw head 32 contact one end of the oblong hole 28 and the recess 27, respectively.

Figure 3A:
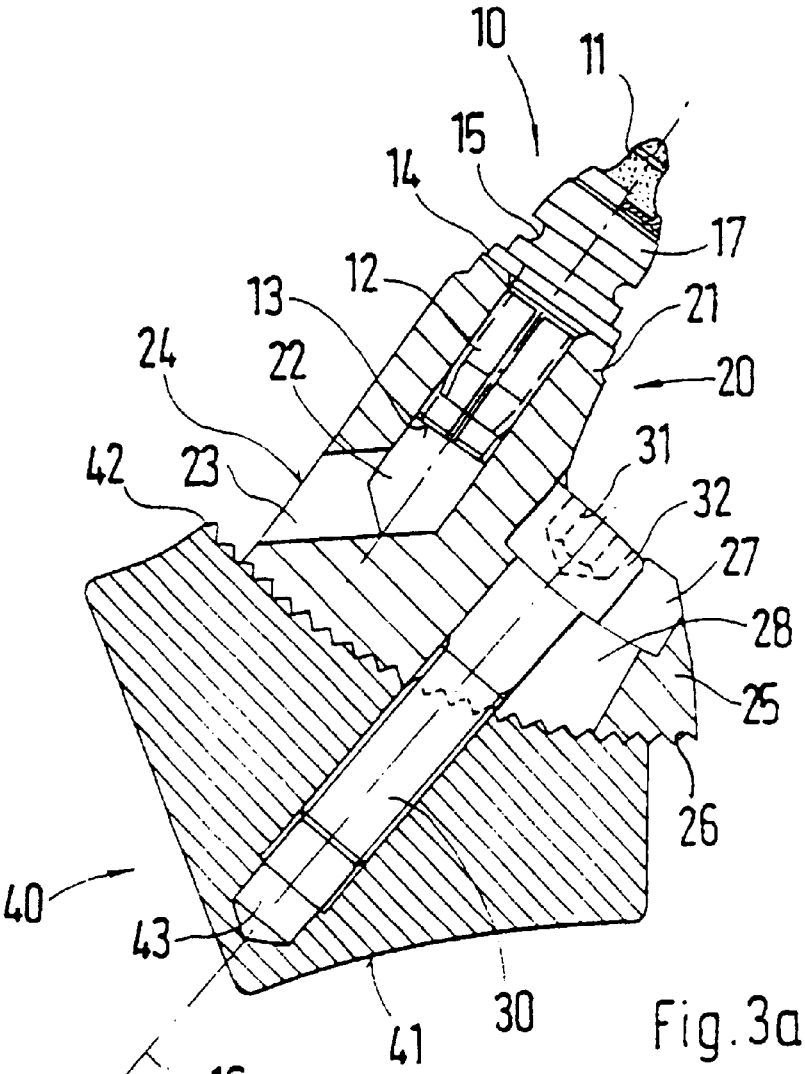
FIGS. 3A and 3B show the chisel-holder changing system from FIGS. 1A and 1B but in a third setting position.
Figure 3B:
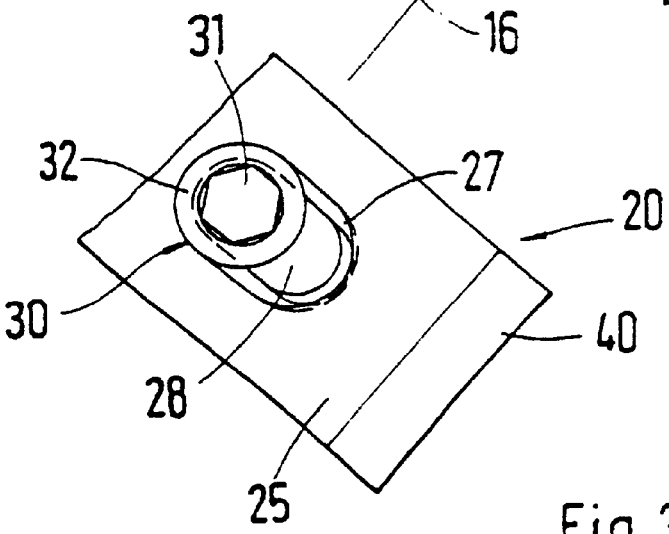

The other maximum working angle $\alpha$ is illustrated in FIGS. 3A and 3B. Here, the fastening screw and the screw head 32 contact the other end of the oblong hole 28 and the recess 27, respectively. In FIGS. 3A and 3B, a working angle $\alpha$ of 35° is realized. Independently of the setting position of the chisel holder 20, the central longitudinal axis 16 of the chisel 10 is normal to the contact surface of the base part 40. Here, an optimum transfer of forces generated during operation is possible.

In the embodiment shown in FIGS. 1A–3B, a cylindrical geometry is chosen for the screw head 32 of the fastening screw. For improving the contact pressure, an oval-head geometry can also be used. The screw head 32 includes a tool receiver 31 for loosening and tightening the fastening screw.

Figure 4:
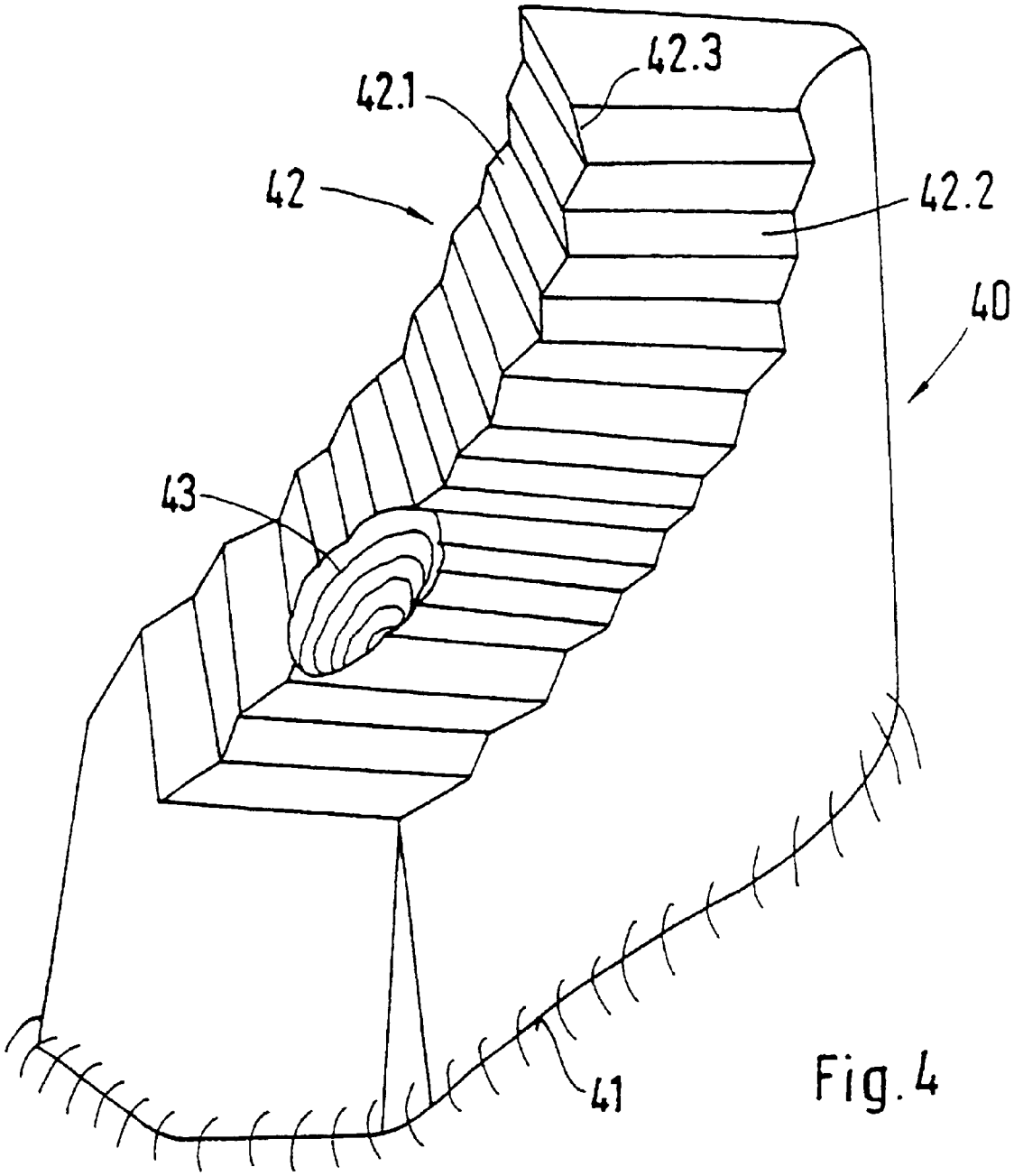
FIG. 4 shows one embodiment of a base part for a chisel-holder changing system, in a perspective view.

One embodiment of the base part 40 is shown in a perspective view, in FIG. 4. As shown, the counter-toothing 42 is divided into two sets of partial toothing 42.1 and 42.2. The two sets of partial toothing 42.1 and 42.2 are slanted in the direction perpendicular to the direction of advance of the cylindrical stem chisel 10. In this way, a serrated-tooth shaped edge 42.3 is formed in the transition region between the two sets of partial toothing 42.1 and 42.2. The toothing 26 of the chisel holder 20 is also realized corresponding to this formation of the counter-toothing 42. Due to this configuration, the forces acting perpendicular to the direction of advance of the chisel can be transmitted by a positive fit through the toothing 26 and the counter-toothing 42 into the base part 40.

Figure 5:
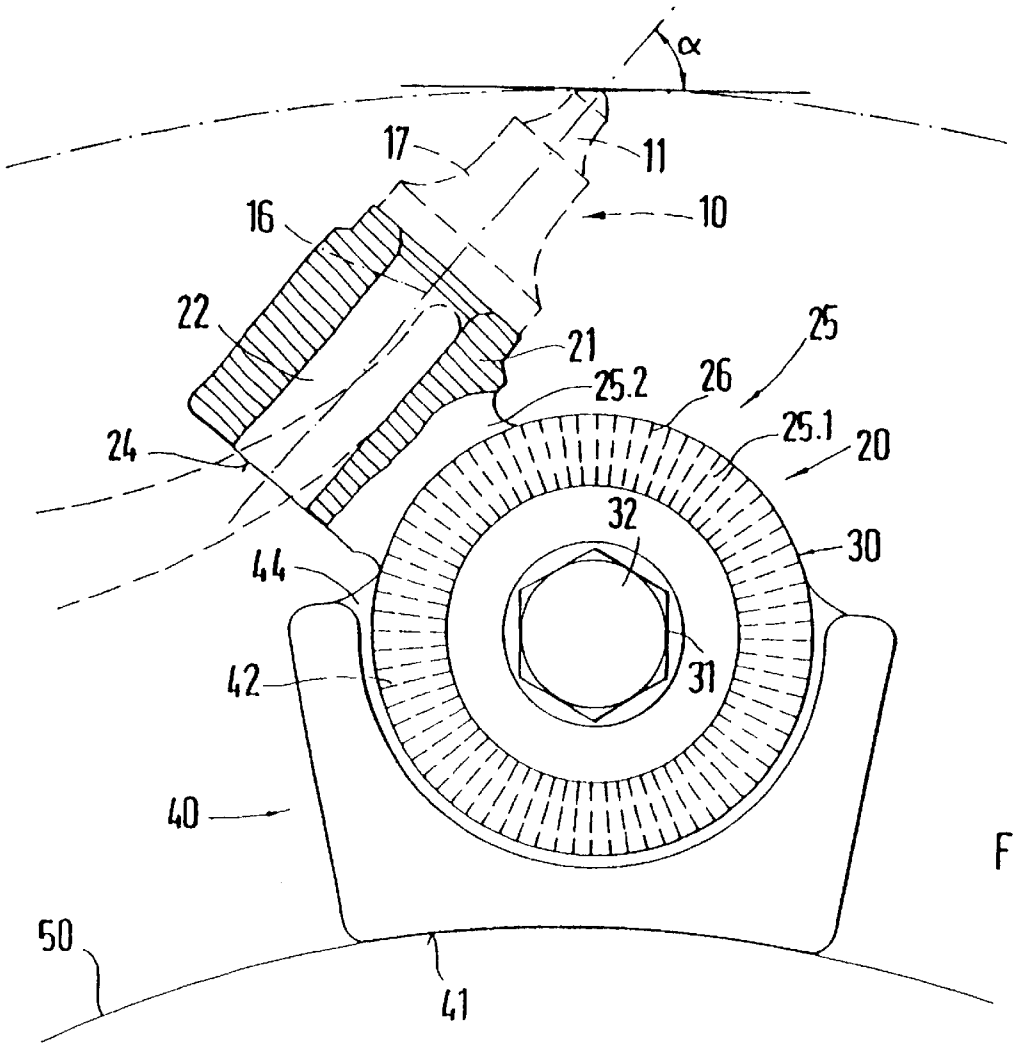
FIG. 5 shows a side view of another embodiment of a chisel-holder changing system.

Another embodiment of a chisel-holder changing system is shown in FIG. 5. As shown in this representation, the base part 40 with its connecting surface 41 is set on the surface of a roller body 50. The base part 40 has a contact part 44. The contact part 44 has a star-shaped counter-toothing 42. In this way, the individual teeth of the counter-toothing 42 project radially outwards from a common center. The central longitudinal axis of the fastening screw, of which the screw head 32 is shown in FIG. 5, is also arranged in this common center. A gripping plate 25.1 of the base 25 of the chisel holder 20 can be set on the contact part 44. The gripping plate 25.1 has a toothing 26 that is formed adapted to the counter-toothing 42 of the base part 40. The toothing connection shown in FIG. 5 is usually designated as Hirth-type serrations. The bracing of the toothing 26 with the counter-toothing 42 is done by means of the fastening screw. When the fastening screw is loose, the chisel holder 20 can be moved in steps, corresponding to the toothing division relative to the base part 40. Thus, the working angle $\alpha$ of the chisel 10 is also changed.

With the chisel-holder changing systems shown in the drawings, the working angle $\alpha$ can be changed quickly and without great effort. Accordingly, the removal tool, for example a road milling machine, can be easily adapted to different applications. For example, if a larger working angle a is chosen, then a fine surface roughness can be created during road milling. However, small working angles a lead to a large waste volume and simultaneously greater roughness.

What is claimed is:

1. In a chisel-holder changing system for a road milling machine or a coal-cutting machine having a base part to which a chisel holder is fastened in an exchangeable manner with a connecting mechanism, wherein the chisel holder accommodates at least one chisel that can be exchanged, and wherein a central longitudinal axis of the chisel is set at a working angle of less than 90° relative to a surface to be worked, the improvement comprising: the chisel being a cylindrical stem chisel with a chisel head and a chisel stem, the chisel head rotatably insertable in a bored receiver of the chisel holder (20), an axis of rotation formed by the chisel stem adjustable in a working angle, the chisel holder (20) fixable by the connecting mechanism in at least two attachment positions to the base part (40), and in different attachment positions of the chisel the central longitudinal axis (16) of the chisel (10) being slanted at various working angles (α).

2. In the chisel-holder changing system according to claim 1, wherein the chisel holder (20) is supported by a support surface on a contact surface of the base part (40), and the chisel holder (20) can be moved on a support surface relative to the contact surface for achieving the different attachment positions.

3. In the chisel-holder changing system according to claim 2, wherein the chisel holder (20) is moved in steps relative to the base part (40).

4. In the chisel-holder changing system according to claim 3, wherein the chisel holder (20) has toothing (26) that engages counter-toothing (42) of the base part (40), and the toothing (26) and the counter-toothing (42) have flat support edges that extend perpendicular to a movement direction of the chisel holder (20) relative to the base part (40).

5. In the chisel-holder changing system according to claim 4, wherein the counter-toothing (42) of the base part (40) has two sets of partial toothing (42.1, 42.2), and the sets of partial toothing are slanted in the direction perpendicular to the direction of advance of the chisel (10) for receiving transverse forces (42.1, 42.2).

6. In the chisel-holder changing system according to claim 4, wherein the base part (40) has a contact part (44) configured with a plurality of concentrically arranged tooth elements of the counter toothing (42), the chisel holder (20) carries a gripping plate (25) that has the toothing (26) adapted to the counter-toothing (42), and the chisel holder (20) is rotatable relative to the base part (40) about an axis of rotation that is perpendicular to a direction of advance of the chisel (10).

7. In the chisel-holder changing system according to claim 6, wherein the chisel holder (20) has a base (25) that carries a holder attachment (21) for receiving the chisel (10), the base (25) has an oblong hole (28) aligned with a threaded receiver (43) of the base part (20), a fastening screw is insertable into the oblong hole (28) and can be screwed into the threaded receiver (43), and the chisel holder (20) is moved when the fastening screw is loose.

8. In the chisel-holder changing system according to claim 7, wherein the oblong hole (28) expands into a recess (27) in which a screw head (32) of the fastening screw is housed.

9. In the chisel-holder changing system according to claim 8, wherein the screw head (32) has an oval head.

10. In the chisel-holder changing system according to claim 9, wherein the chisel holder (20) carries a holder attachment (21) on the base (25), the holder attachment (21) has a receiving hole (22) for a chisel stem of the chisel (10), and the holder attachment (21) is connected to the base (25) through a set breaking point (25.2).

11. In the chisel-holder changing system according to claim 1, wherein the chisel holder (20) is moved in steps relative to the base part (40).

12. In the chisel-holder changing system according to claim 1, wherein the chisel holder (20) has toothing (26) that engages counter-toothing (42) of the base part (40), and the toothing (26) and the counter-toothing (42) have flat support edges that extend perpendicular to a movement direction of the chisel holder (20) relative to the base part (40).

13. In the chisel-holder changing system according to claim 12, wherein the base part (40) has a contact part (44) configured with a plurality of concentrically arranged tooth elements of the counter toothing (42), the chisel holder (20) carries a gripping plate (25) that has the toothing (26) adapted to the counter-toothing (42), and the chisel holder (20) is rotatable relative to the base part (40) about an axis of rotation that is perpendicular to a direction of advance of the chisel (10).

14. In a chisel-holder changing system for a road milling machine or a coal-cutting machine having a base part to which a chisel holder is fastened in an exchangeable manner with a connecting mechanism, wherein the chisel holder accommodates at least one chisel that can be exchanged, and wherein a central longitudinal axis of the chisel is set at a working angle of less than 90° relative to a surface to be worked, the improvement comprising: the chisel being a cylindrical stem chisel with a chisel head and a chisel stem, the chisel head rotatably insertable in a bored receiver of the chisel holder (20), an axis of rotation formed by the chisel stem adjustable in a working angle, the chisel holder (20) fixable in at least two attachment positions to the base part (40), wherein in different attachment positions of the chisel the central longitudinal axis (16) of the chisel (10) is slanted at various working angles (α); and the chisel holder (20) having toothing (26) that engages counter-toothing (42) of the base part (40), the toothing (26) and the counter-toothing (42) having flat support edges that extend perpendicular to a movement direction of the chisel holder (20) relative to the base part (40), the counter-toothing (42) of the base part (40) having two sets of partial toothing (42.1, 42.2), the sets of partial toothing slanted in the direction perpendicular to the direction of advance of the chisel (10) for receiving transverse forces (42.1, 42.2).

15. In a chisel-holder changing system for a road milling machine or a coal-cutting machine having a base part to which a chisel holder is fastened in an exchangeable manner with a connecting mechanism, wherein the chisel holder accommodates at least one chisel that can be exchanged, and wherein a central longitudinal axis of the chisel is set at a working angle of less than 90° relative to a surface to be worked, the improvement comprising: the chisel being a cylindrical stem chisel with a chisel head and a chisel stem, the chisel head rotatably insertable in a bored receiver of the chisel holder (20), an axis of rotation formed by the chisel stem adjustable in a working angle, the chisel holder (20) fixable in at least two attachment positions to the base part (40), wherein in different attachment positions of the chisel the central longitudinal axis (16) of the chisel (10) is slanted at various working angles (α); and the chisel holder (20) having a base (25) that carries a holder attachment (21) for receiving the chisel (10), the base (25) having an oblong hole (28) aligned with a threaded receiver (43) of the base part (20), a fastening screw insertable into the oblong hole (28) and screwable into the threaded receiver (43), the chisel holder (20) being movable when the fastening screw is loose.

16. In the chisel-holder changing system according to claim 15, wherein the oblong hole (28) expands into a recess (27) in which a screw head (32) of the fastening screw is housed.

17. In the chisel-holder changing system according to claim 15, wherein the screw head (32) has an oval head.

18. In a chisel-holder changing system for a road milling machine or a coal-cutting machine having a base part to which a chisel holder is fastened in an exchangeable manner with a connecting mechanism, wherein the chisel holder accommodates at least one chisel that can be exchanged, and wherein a central longitudinal axis of the chisel is set at a working angle of less than 90° relative to a surface to be worked, the improvement comprising: the chisel being a cylindrical stem chisel with a chisel head and a chisel stem, the chisel head rotatably insertable in a bored receiver of the chisel holder (20), an axis of rotation formed by the chisel stem adjustable in a working angle, the chisel holder (20) fixable in at least two attachment positions to the base part (40), wherein in different attachment positions of the chisel the central longitudinal axis (16) of the chisel (10) is slanted at various working angles ($\alpha$); and the chisel holder (20) having a holder attachment (21) on a base (25), the holder attachment (21) having a receiving hole (22) for a chisel stem of the chisel (10), and the holder attachment (21) connected to the base (25) through a set breaking point (25.2).

* * * * *